US006209472B1

(12) United States Patent
Staerzl

(10) Patent No.: US 6,209,472 B1
(45) Date of Patent: Apr. 3, 2001

(54) APPARATUS AND METHOD FOR INHIBITING FOULING OF AN UNDERWATER SURFACE

(75) Inventor: Richard E. Staerzl, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/188,967

(22) Filed: Nov. 9, 1998

(51) Int. Cl.[7] ..... B63B 59/00
(52) U.S. Cl. ..... 114/222; 205/729
(58) Field of Search ..... 205/728, 729; 114/222; 204/196.05, 196.36

(56) References Cited

U.S. PATENT DOCUMENTS

| | | | | |
|---|---|---|---|---|
| 948,355 | | 2/1910 | Tatro et al. . | |
| 1,021,734 | * | 3/1912 | Delius et al. | 205/729 |
| 3,241,512 | | 3/1966 | Green | 114/222 |
| 3,625,852 | | 12/1971 | Anderson | 204/196 |
| 3,766,032 | * | 10/1973 | Yeiser | 204/147 |
| 4,012,503 | | 3/1977 | Freiman | 424/145 |
| 4,046,094 | | 9/1977 | Preiser et al. | 114/222 |
| 4,058,075 | | 11/1977 | Piper | 114/222 |
| 4,170,185 | | 10/1979 | Murphy et al. | 114/222 |
| 4,196,064 | | 4/1980 | Harms et al. | 204/147 |
| 4,214,909 | | 7/1980 | Mawatari | 106/16 |
| 4,256,556 | | 3/1981 | Bennett et al. | 204/147 |
| 4,283,461 | | 8/1981 | Wooden et al. | 428/422 |
| 4,297,394 | | 10/1981 | Wooden et al. | 427/100 |
| 4,322,633 | | 3/1982 | Staerzl | 307/95 |
| 4,345,981 | | 8/1982 | Bennett et al. | 204/129 |
| 4,559,017 | | 12/1985 | Cavil et al. | 440/76 |
| 4,869,016 | | 9/1989 | Diprose | 43/124 |
| 5,009,757 | | 4/1991 | Riffe et al. | 204/147 |
| 5,052,962 | | 10/1991 | Clark | 440/49 |
| 5,055,165 | | 10/1991 | Riffe et al. | 204/147 |
| 5,088,432 | | 2/1992 | Usami | 114/67 |
| 5,143,011 | | 9/1992 | Rabbette | 114/222 |
| 5,182,007 | * | 1/1993 | Takagi et al. | 204/196.36 |
| 5,298,794 | | 3/1994 | Kuragaki | 307/95 |
| 5,318,814 | | 6/1994 | Elliott et al. | 428/36.92 |
| 5,342,228 | | 8/1994 | Magee et al. | 440/76 |
| 5,344,531 | * | 9/1994 | Saito et al. | 204/147 |
| 5,346,598 | | 9/1994 | Riffe et al. | 204/147 |
| 5,351,640 | | 10/1994 | Attaway et al. | 114/222 |
| 5,386,397 | | 1/1995 | Urroz et al. | 367/139 |
| 5,431,122 | | 7/1995 | Templet, Jr. | 114/222 |
| 5,465,676 | | 11/1995 | Falcaro | 114/222 |
| 5,532,980 | | 7/1996 | Zarate et al. | 367/139 |
| 5,629,045 | | 5/1997 | Veech | 427/297 |
| 5,643,424 | | 7/1997 | Riffe et al. | 204/196 |
| 5,716,248 | | 2/1998 | Nakamura | 440/76 |
| 5,820,737 | | 10/1998 | Kohn | 204/196 |
| 5,868,920 | * | 2/1999 | Nylund et al. | 205/728 |

FOREIGN PATENT DOCUMENTS

| | | |
|---|---|---|
| 89250075 | 11/1989 | (EP) . |
| 1319428 | 1/1962 | (FR) . |
| WO96/13425 | 11/1995 | (WO) . |

OTHER PUBLICATIONS

Baltimore Business Journal, vol. 10, No. 47, Section 1, p. 3.
Chemistry and Industry, Section 5, p. 123.

* cited by examiner

*Primary Examiner*—Ed Swinehart
(74) *Attorney, Agent, or Firm*—William D. Lanyi

(57) ABSTRACT

A system for inhibiting marine organism growth on underwater surfaces provides an electric current generator which causes an electric current to flow proximate the underwater surface. A source of power, such as a battery, provides electrical power to the electric current generator. The flow of current passes from the underwater surface through water surrounding the surface or in contact with the surface, and a point of ground potential. The point of ground potential can be a marine propulsion system attached to a boat on which the underwater surface is contained.

7 Claims, 6 Drawing Sheets

APPARATUS AND METHOD FOR INHIBITING FOULING OF AN UNDERWATER SURFACE

BACKGROUND OF THE INVENTION

1. Field of the Invention

The present invention is generally related to an anti-fouling apparatus for marine components and, more particularly, to a device that creates an electric current in the region proximate an underwater surface in order to inhibit the growth of marine life on an underwater surface such as a boat hull.

2. Description of the Prior Art

For over a thousand years, it has been known that a ship's hull is subject to fouling by marine growth. Copper cladding had been used successfully for many years until the introduction of vessels with iron hulls which prevented its use because of the potential for galvanic action. By 1850, various paints containing copper salts had been developed. Over the past few centuries, the pace of the development of anti-fouling techniques has been influenced by warfare, and several naval encounters have been decided by the greater speed of a naval vessel that resulted because of superior anti-fouling technology.

Currently, copper salts are used in the majority of anti-fouling paints, although the most effective modem anti-foulings contain tributyltin (TBT) as well as copper salts. Recent restrictions on the use of TBT and anti-fouling paints has led to renewed interest in developing novel, environmentally acceptable anti-fouling techniques.

Throughout the description of the present invention, the unwanted growth on a ship's hull or other underwater surface will be referred to as fouling. Although fouling is primarily a biological phenomenon, its implication relate to engineering Due to an increase in the resistance to movement of the hull through water, fouling of the hulls of ships results in a reduction in speed, an increase in the cost of fuel, and losses in both time and money in the application of remedial measures.

Underwater surfaces rapidly absorb organic material, referred to as conditioning films, which may influence the subsequent settlement of microorganisms. Bacteria and diatoms are soon present after immersion in water, resulting in a slime that covers the submerged surface. Following the establishment of the micro fouling slime layer, macro fouling rapidly develops. The macro fouling community is often described as either soft fouling or hard fouling. Soft fouling comprises algae and invertebrates such as soft corals, sponges, anemones, tunicates, and hydroids while hard fouling comprises invertebrates such as barnacles, mussels, and tubeworms.

Mariners from ancient times were aware of the problems resulting from both is boring and fouling organisms. Various treatments were employed, and some of these techniques have been retried many times in many forms over more than 2,000 years. The ancient Phoenicians and Carthaginians addressed this problem over 400 years BC. The Greeks and Romans both independently used lead sheathing which the Romans secured by copper nails. In the early 16th century, Spain officially adopted lead sheathing and its use soon spread to France and England. Although it actually offered little in the way of protection against fouling, lead was the material most frequently used prior to the eighteenth century. However, its corrosive effect on iron ships was soon noticed and the British Admiralty abandoned the use of lead in 1682 for that reason.

Other treatments to prevent worms from penetrating the planking relied on a wooden sheath placed over a layer of animal hair and tar. The wooden sheathing was sometimes filled with iron or cooper nails that had large heads. This, in effect, created an outer metallic cladding. Paints were also used that had mixtures of tar, brimstone and grease. The first successful anti-fouling device was copper sheathing and the first documented evidence for the use of copper as an anti-fouling method dates back to 1625. Copper was used in 1758 on the hull of the HMS Alarm, and by 1780 copper was in general use by the British Navy. Sir Humphry Davy showed that it was actually the dissolution of the copper in sea water that prevented fouling.

In the nineteenth century, with the growing importance of iron ship building, the use of copper sheathing on the boats was discontinued. As a result, the weight of fouling quickly made the ships unmaneuverable and unseaworthy. Various alternatives were tried including sheathings of zinc, lead, nickel, galvanized iron and alloys of antimony, zinc and tin, followed by wooden sheathing which was then layered with copper.

By 1960, metallic soap was applied hot and contained copper sulfate. From these early attempts at coatings, anti-fouling paints incorporating cuprous oxide, mercuric oxide, or arsenic in shellac varnish or a resin matrix with turpentine, naphtha or benzene as solvents developed. From these formulations, modern anti-fouling paints were developed. Anti-fouling paints are currently in wide use on yachts and pleasure crafts as well as deep sea vehicles. The presence of tributyltin (TBT) in estuaries and in the sea is thought to result from the increased use of tributyltin-containing paints on these types of vessels.

Another technique for inhibiting fouling is to reduce the ease with which bacteria and algae adhere to the surfaces. The main type of low energy non-biocidal coatings are fluoro-polymers and silicones. Fluoropolymers have been under development in the United States during the past several decades. They are based on fluoro-polyurethane paints, either pigmented with PTFE or containing silicone for fluoro-epoxy additives. Although the surfaces do accumulate fouling organisms, their attachment is weak. Coatings developed to date require twice yearly cleaning with bristled brushes to remove fouling growth and can therefore only be useful as coatings on small boats.

Various other non-toxic techniques have been attempted. Both ultrasonic (e.g. 14 kHz) and low frequency (e.g. 30 Hz) sound waves inhibit barnacle settlement and may have application to fouling control in certain circumstances. These and many other anti-fouling techniques are described in an article written by Maureen Callow in the publication titled "Chemistry and Industry" at Section 5, pg. 123, on Mar. 5, 1990.

As described in the Baltimore Business Journal, Vol. 10, No. 47, Section 1, pg. 3 on Apr. 23, 1993, McCormick & Company has discovered that its red pepper extracts are natural repellents of barnacles and zebra mussels. A coating of this type has been tested, and it has been determined that it repels both barnacles and zebra mussels which have become costly nuisances in the Great Lake Region by clogging intake pipes for power plants and water treatment plants. It is estimated that several billion dollars in damage will be caused by zebra mussels before the turn of the century.

U.S. Pat. No. 5,532,980, which issued to Zarate, et. al. on Jul. 2, 1996, discloses a vibrational anti-fouling system. The system produces vibrations in an underwater structure for the purpose of inhibiting the attachment of aquatic life forms to the structure. The system includes a controller which drives one or more transducers. The transducer comprises a housing, one end of which i s closed by a resilient diaphragm. An electromagnet with soft magnetic core is contained in the housing spaced from the unsupported portion of the diaphragm. The unsupported portion of the diaphragm is mounted over an underwater structure. In operation, the electromagnet is excited with a current pulse, which deforms the diaphragm so that the housing moves towards the structure. As the current drops off, the diaphragm is restored to its original shape and the housing moves away from the structure imparting a vibrational force to the structure. The transducer includes an elastic membrane to compensate the changes in temperature and pressure commonly found when working underwater. The magnetic cores positioned in the transducers are saturated by current pulses generated by the controller to eliminate the effects of component variations and allow multiple units to be connected to the controller without changes in sound levels. The system is highly resistant to electrolytic corrosion since, most of the time, there is no voltage difference between the resonators, wires and ground.

U.S. Pat. 5,386,397, which issued to Urroz on Jan. 31, 1995, describes a method and apparatus for keeping a body surface, which is in contact with water, free of fouling. A sound wave is generated for keeping a surface free of scale, fouling and dirt by the adherence of organisms such as marine life, the surface being part of the body that is in contact with water. The method comprising of steps of generating and emitting from at least one location of the body, at least one high frequency sound wave train forming, adjacent to the body surface, a vibrating field encircling the body surface. The molecular energy of the water within the field is increased to generate a drastic drop in the density of the water as well as the density of the cells of the organisms entering the vibrating field. This alters the habitat of the organisms and discourages the organisms from adhering to the body surface.

U.S. Pat. 4,058,075, which issued to Piper on Nov. 15, 1977, discloses a marine life growth inhibitor device. The device is used for inhibiting marine life on the outer surface of submerged object such as boat. The device includes a controller connected to a source of electrical power and a plurality of speakers electrically connected to the controller and attached at predetermined locations on the interior of the boat's hull, whereby vibrations may be transmitted through the hull. The controller may also include a transformer for reducing the voltage of the alternating current power source. Each of the plurality of speakers has a speaker diaphragm having first and second speaker diaphragm sides. Each of the speakers is mounted in a speaker housing secured to the hull of the boat for enabling transfer of acoustical energy from both the first and second side of the speaker diagram to the boat hull to inhibit the growth of marine life on the exterior surface of the boat hull. The speakers are selected to produce acoustical vibration in the audible range.

U.S. Pat. No. 5,143,011, which issued to Rabbette on Sep. 1, 1992, discloses a method and apparatus for inhibiting barnacle growth on boats. The system for inhibiting growth of barnacles and other marine life on the hull of a boat includes a plurality of transducers or vibrators mounted on the hull and alternately energized at a frequency of 25 Hertz through a power source preferably the boat battery, and a control system. The system has two selectable operating modes. One is continuous and the other is periodic. Also, when the voltage of the battery falls below a predetermined level, transducers are automatically deenergized to allow charging of the battery after which the transducers are energized.

U.S. Pat. No. 5,629,045, which issued to Veech on May. 13, 1997, describes a biodegradable nosiogenic agents for control of non-vertebrae pests. Fouling of marine structures, such as boats, by shell bearing sea animals which attach themselves to such structures, such as barnacles, is generally inhibited by coatings containing lipid soluble, non-toxic, biodegradable substances which prevent the animals from sitting down on the structures. These substances attack the nervous system of the barnacle, neutralize the glue extruded by the barnacle, and otherwise prevent the barnacles from attaching themselves to surfaces immersed in the aqueous marine environment while being benign to the environment. A preferred inhibitor is pepper containing capsaicin. The inhibitor is incorporated into standard marine paints, impregnates, varnishes and the like.

U.S. Pat. No. 5,318,814, which issued to Elliott et al on Jun. 7, 1994, describes the inhibiting of the settling of barnacles. Settlement of barnacles on surfaces in a marine environment is inhibited by employing as a construction material for said surfaces of polymers including methyl methacrylate and an effective amount (preferably about 2% to about 10%) of a copolymerizable N-substituted maleimide.

U.S. Pat. No. 4,012,503, which issued to Freiman on Mar. 15, 1977, discloses a coating composition used to control barnacles. Toxicant compositions containing the combination of tri-n-butyltin fluoride with zinc oxide and specified substituted triazines effectively inhibit the development of marine organisms, including barnacles and algae, that are responsible for fouling. These compositions are particularly useful as the active component in antifouling coatings.

U.S. Pat. No. 4,214,909, which issued to Mawatari et al on Jul. 29, 1980, describes an aquatic antifouling method. The method for controlling fouling to structures caused by aquatic fouling organisms such as barnacles, slime, sea moss, algae, etc. which comprises applying to the structures sesquiterpene alcohols such as farnesol, nerolidol, and dehydronerolidol, and the organic carboxylic acid esters thereof.

U.S. Pat. No. 5,465,676, which issued to Falcaro on Nov. 14, 1995, discloses a barnacle shield. A system for discouraging and inhibiting marine growth onto a boat's underwater hull surface comprises a plurality of sections of foam filled PVC pipe tied together to form a flotation frame, an envelope of flexible, polyethylene, bubble wrap material, of a size and shape to enclose the underwater part of a boat's hull, and affixed to and supported by the flotation frame, a sprinkler hose affixed to the flotation frame for injecting fresh water for washing the boat's underwater hull, and a plurality of drain/check valves mounted in the envelope for eliminating the wash down water in the envelope.

U.S. Pat. No. 4,170,185, which issued to Murphy et al on Oct. 9, 1979, describes a means for preventing marine fouling. The effective antifouling result with respect to marine creatures such as barnacles is achieved by energizing a piezofilm layer carried on the outside of a vessel to cause mechanical vibration of the layer.

U.S. Pat. No. 4,046,094, which issued to Preiser et al on Sep. 6, 1977, discloses an antifouling system for active ships which are at rest. A system for discouraging and inhibiting growth of the entire marine fouling community onto a ship hull while it is at rest in brackish or seawater is described. A pipe or pipes having nozzles distributed therealong, run the length of the keel. Fresh water is supplied to the pipe which flows out the nozzles and up along the hull to create and maintain a moving boundary layer of fresh water. Such movement also serves to inhibit fouling. An enclosure comprising segmented, over-lapping opaque curtains hang down by weights, from the ship-deck. These curtains serve to prevent light from reaching the hull, and to protect the thin boundary layer of fresh water from the disruptive, mixing actions caused by the surrounding currents. Thus the marine fouling community, including tubeworms, barnacles, grass, and algae, may be inhibited from growing and adhering to the hull surface.

U.S. Pat. No. 4,283,461, which issued to Wooden et al on Aug. 11, 1981, describes a piezoelectric polymer antifouling coating. An antifouling coating for marine structures in the form of a film containing piezoelectric polymer material, which, when electrically activated vibrates at a selected frequency to present a surface interfacing with water which is inhospitable for attachment of vegetable and animal life including free-swimming organisms thereby discouraging their attachment and their subsequent growth thereon to the macrofoulant adult stage is disclosed.

U.S. Pat. No. 5,342,228, which issued to Magee et al on Aug. 30, 1994, discloses a marine drive which is provided with a large volume anode, about 30 cubic inches, for galvanic protection. The anode is a brick-like block member tapered along each of its height, width, and length dimensions. The drive housing has a anode mounting section extending rearwardly therefrom and has a downwardly opening cavity of substantially the same shape and volume as the anode, and receiving the anode in nested flush relation.

U.S. Pat. No. 5,716,248, which issued to Nakamura on Feb. 10, 1998, discloses a sacrificial anode for a marine propulsion unit. The sacrificial anode arrangements for a marine propulsion unit is disclosed wherein the sacrificial anode is juxtaposed to the trim tab and is detachably connected to the lower unit housing by fastening means which can be removed from the upper surface thereof. In one embodiment, the trim tab is detachably connected to the sacrificial anode and is connected to the outer housing portion through the sacrificial anode.

U.S. Pat. No. 5,298,794, which issued to Kuragaki on Mar. 29, 1994, describes an electrical anticorrosion device for a marine propulsion apparatus. The device primarily relates to an electrical anticorrosion apparatus for a marine propulsion arrangement. More particularly, the device relates to an anodic protection arrangement which is suitable for use with an inboard/outboard propulsion unit. According to the description in this patent, an anode and the reference electrode are housed within a housing unit which is mounted upon a propulsion unit mounting bracket. The two electrodes are arranged so that each is essentially equidistant from a point located approximate midway across the lateral width of an outboard drive unit, which unit is secured to the mounting bracket, when the unit is positioned for driving the associated watercraft in a generally forward direction.

U.S. Pat. No. 4,322,633, which issued to Staerzl on Mar. 30, 1982, discloses a marine cathodic protection system. The system maintains a submerged portion of the marine drive unit at a selected potential to reduce or eliminate corrosion thereto. An anode is energized to maintain the drive unit at a pre-selected constant potential in response to the sensed potential at a closely located reference electrode during operation. Excessive current to the anode is sensed to provide a maximum current limitation. An integrated circuit employs a highly regulated voltage source to establish precise control of the anode energization.

U.S. Pat. No. 5,052,962, which issued to Clark on Oct. 1, 1991, describes a naval electrochemical corrosion reducing. The corrosion reducer is used with ships having a hull, a propeller mounted on a propeller shaft and extending through the hull, therein supporting the shaft, at least one thrust bearing and one seal. Improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and the power output circuit receiving signals from the differential amplifier and being supplied by at least one current supply. The current selector includes a brush assembly in contact with a slip ring over the shaft so that its potential may be applied to the differential amplifier.

U.S. Pat. No. 4,559,017, which issued to Cavil et al on Dec. 17, 1985, discloses a constant voltage anode system. The marine propulsion unit has a housing exposed to sea water and subject to attack by the sea water. It has a permanent type anode housing with a substantially constant surface characteristic which is mounted on the housing and supplied with constant voltage. Holes under the anode through the housing which extend to interior passages permits the current of the anode to influence and protect the passages.

The patents described above are hereby explicitly incorporated by reference in the following description.

Over the previous thousand years that mankind has ventured across the seas in ships, many attempts have been made to avoid the disastrous effects of marine fouling on the hulls of those ships. These attempts have included various types of cladding, treating, and painting. In addition, electromechanical schemes have been used to vibrate the hulls for the purpose of discouraging the attachment of various types of micro-organisms. Fresh water has been used to discourage the growth of barnacles and other marine life.

As described above, fouling of underwater surfaces has been recognized as a problem for many years. Anti-fouling techniques, such as biocidal paints, can contribute to the pollution of waterways. Many other methods simply are not effective. It would therefore be significantly beneficial if a device or method could be developed which does not pollute the environment, but effectively inhibits the growth of marine organisms on surfaces which are submerged in water such as boat hulls, pipes, pilings, and grates.

SUMMARY OF THE INVENTION

The present invention is directed to a system that inhibits the growth of marine organisms on the hulls of boats and on other items, such as grates for drainage pipes, on which marine growth is particularly deleterious. In a preferred embodiment of the present invention, an apparatus for inhibiting the fouling of an underwater surface comprises an electric current generator for causing an electrical current to flow in the region proximate the underwater surface. The electrical current is transmitted from the underwater surface and into the water surrounding and in contact with the underwater surface. A source of electrical power, such as a battery or electrical generator, is connected in electrical communication with the electric current generator.

There are several ways that the electrical current can be caused to flow into the water which is in close contact with the underwater surface. For example, an electrically conductive paint can be disposed on the underwater surface and connected in electrical communication with the electric current generator. Alternatively, when the fiberglass hull of a watercraft is being manufactured, the outermost layer of the hull can be made electrically conductive. In addition, two electrodes can be advantageously located to cause an electric current to flow parallel and in close proximity to the underwater surface.

In a typical complication of the present invention, the electric current generator forms an electrical circuit in series with the underwater surface, a point of electrical ground potential, and the water surrounding the surface which can be the hull of a watercraft. The point of ground potential can comprise a portion of an outboard motor or stem drive unit disposed at least partially within the water surrounding the watercraft. The underwater surface can be the hull of a boat or any other surface that can be fouled by marine organisms. If the underwater surface is a hull of a watercraft, it can be metallic and used as a conductor from which the electric current flows into the water surrounding the underwater surface. Alternatively, the hull of a watercraft can be electrically non-conductive, but be painted with an electrically conductive paint that is connected in electrical communication with the electric current generator.

The electric current flowing from the electric current generator can be an oscillating circuit which varies in voltage potential between a zero magnitude and a positive magnitude.

In certain applications, such as a boat hull, the underwater surface can be divided into a first surface portion and a second surface portion. These first and second surface portions can be the port side of the hull and the starboard side of the hull, respectively. The first and second surface portions are then electrically insulated from each other except for the water which is disposed electrically between the first and second surface portions and in contact with them. The first and second surface portions can be connected to the electric current generator in an oscillating manner in order to cause the first and second surface portions to reverse electrical polarities relative to each other on a periodic basis.

Throughout the description of the present invention, reference is made to an "underwater surface". The definition of that term, as used herein, includes boat hulls, underwater grates and pipes, underwater support systems for piers and other objects, and other submerged apparatus on which marine organisms can attach. The definition of underwater surface as used in this description does not include the sacrificial anodes which are generally known to those skilled in the art and which typically generate, as part of their basic function, an electrical current of small magnitude in order to prevent corrosion from occurring to certain portions of a marine drive system as a result of galvanic currents caused by the use of dissimilar metals in a water environment. Throughout the description of the present invention, the use of the term "underwater surface" shall mean surfaces which are not part of the known sacrificial anode systems used in conjunction with marine propulsion systems. Instead, this term shall refer to boat hull surfaces, underwater pipes and grating structures used in conjunction with pipes, support beams for piers, derricks, and the like, and other structures which are not typically used to conduct an electrical current into the water surrounding the surfaces of those structures.

BRIEF DESCRIPTION OF THE DRAWINGS

The present invention will be more fully and completely understood from a reading of the description of the preferred embodiment in conjunction with the drawing, in which.

DESCRIPTION OF THE PREFERRED EMBODIMENT

Figure 1:
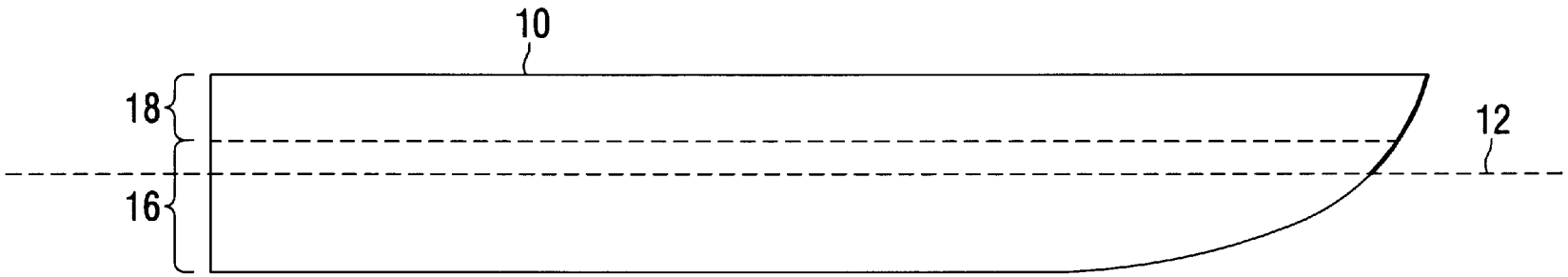
FIGS. 1 and 2 show two views of a watercraft having underwater surfaces.

Throughout the description of the preferred embodiment of the present invention, like components will be identified by like reference numerals.

FIG. 1 shows a watercraft 10 schematically illustrated to show a representative water level 12 surrounding the watercraft. As shown in FIG. 1, a portion of the outer hull surface of the watercraft 10 which is below the water level 12 is submerged and constantly wetted when the watercraft is stationary. As a result of wave action or movement of the boat relative to the water, an additional portion of the hull surface of both the water level 12 is typically wetted on a frequent basis. As a result, the constantly and frequently wetted portions of a hull surface can experience the growth of marine organisms, such as barnacles. That region is referred to as the underwater surface and is identified by reference numeral 16 in FIG. 1. The portion above the underwater surface 16 is identified by reference numeral 18.

Underwater surfaces are particularly susceptible to fouling by marine organisms. As a result, many different techniques have been tried to inhibit marine growth on the hull surfaces of watercraft.

The present invention inhibits marine growth by causing an electric current to flow from the underwater surface 16 into the water surrounding the boat and in contact with the underwater surface. This can be accomplished in several different ways. For example, the current can be caused to flow directly from the underwater surface 16, through the water, and to a point of ground potential. The point of ground potential can be the marine propulsion device (not shown in FIG. 1) used to propel the watercraft 10. Alternatively, the point of ground potential can be any other conductor that serves to complete the electric circuit required to accomplish the function of the present invention.

Figure 2:
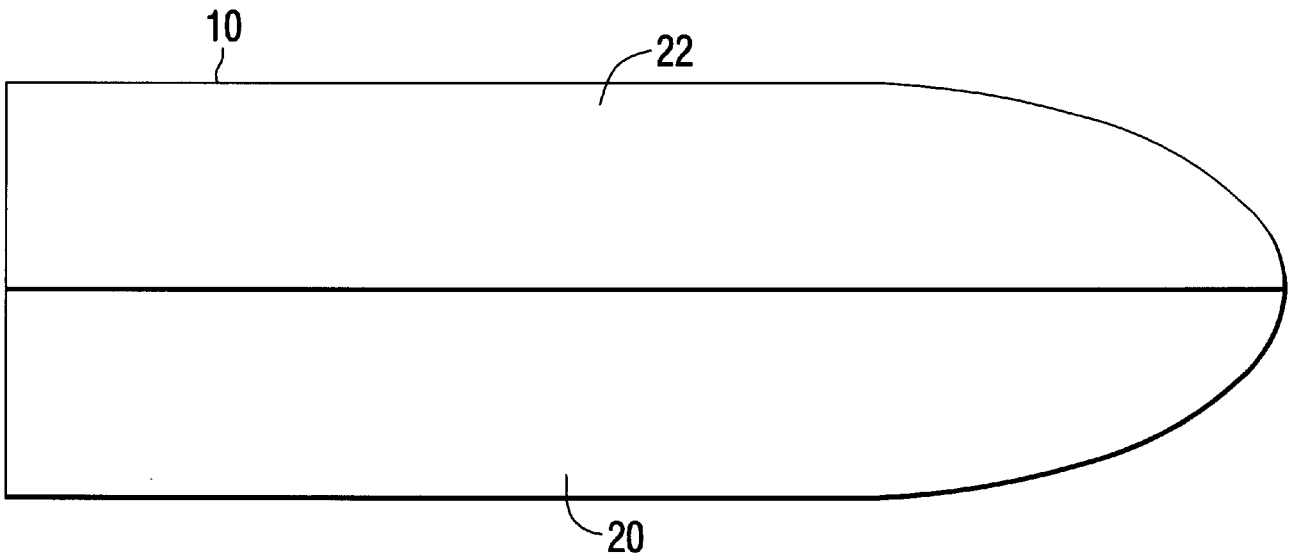

FIG. 2 shows an underside of a hull of the watercraft 10 shown in FIG. 1. The port side of the hull is identified by reference numeral 20 and the starboard side is identified by reference numeral 22. In certain embodiments of the present invention, as will be described in detail below, the flow of electric current can be caused to oscillate from a first condition when the current is flowing from the port side 20 to the starboard side 22 and a second condition when the current is flowing from the starboard side 22 to the port side 20. By alternating the direction of current flow in this manner, degradation of the anodic surfaces can be avoided. Alternatively, the entire hull surface of the watercraft 10 can be used as the anodic surface and the electric current can be caused to flow from the underwater surface of the hull, through the water, and to the point of ground potential at the marine propulsion unit in a DC or pulsed manner.

Figure 3:
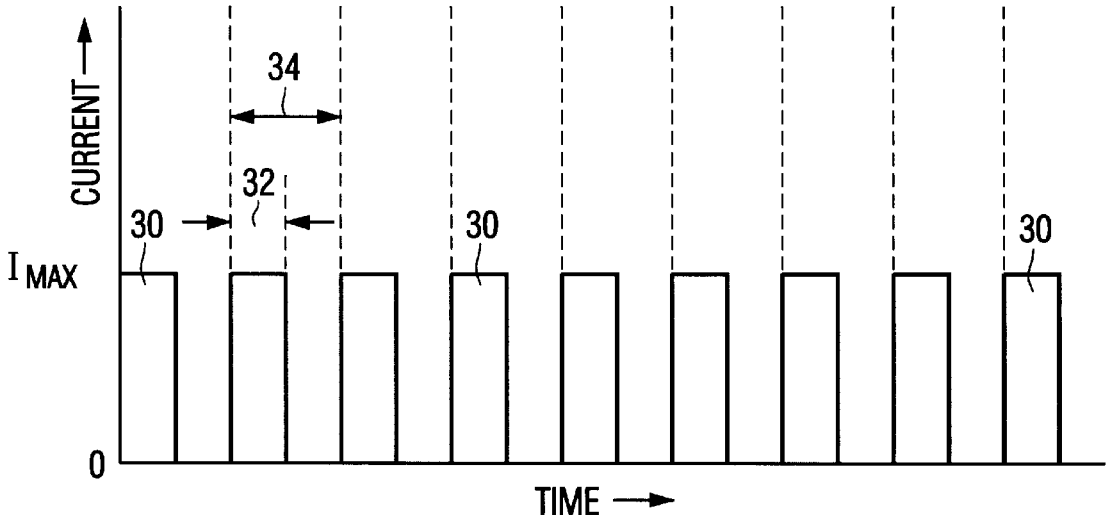
FIGS. 3 and 4 show two series of pulses which illustrate how duty cycle can be used to regulate average current.

In a preferred embodiment of the present invention, the electric current flows in pulses from the underwater surface and into the surrounding water. FIG. 3 illustrates the manner in which the average current is controlled in a preferred embodiment of the present invention. The current pulses 30 are regulated to have a maximum magnitude $I_{MAX}$. The average current is determined by regulating the duty cycle of the series of pulses 30. For example, in FIG. 3 the duty cycle is shown as approximately 50%. In other words, the current is on during the period of the pulses identified by reference numeral 32 and off for the remainder of the total time period identified by reference numeral 34. The percentage calculated by dividing time period 32 by time period 34 is the duty cycle of the series of pulses 30.

Figure 4:
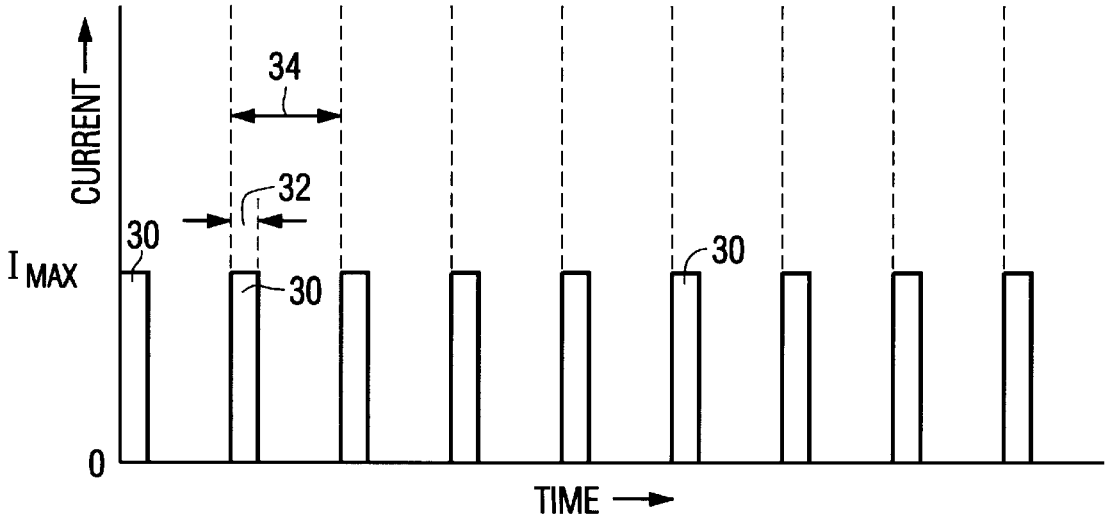

Using the same maximum magnitude $I_{MAX}$ of current, a lower average current can be provided by reducing the duty cycle. This is represented in FIG. 4. Each pulse is on for a smaller percentage of the total time period 34. As a result, the average current flowing from the underwater surface is less in the example shown in FIG. 4 than the example shown in FIG. 3.

Figure 5:
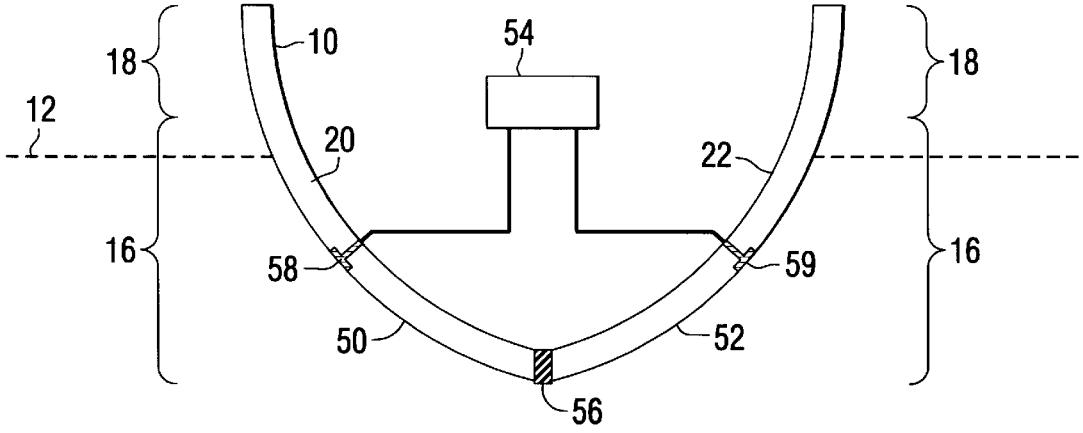
FIG. 5 is a section view of a watercraft showing both port and starboard hull sections.

FIG. 5 shows a section view taken through the hull of a watercraft 10, showing the port side 20 and the starboard side 22 of the watercraft. Reference numeral 16 identifies the underwater surface of the hull and reference numeral 18 defines the portion above the underwater surface. As described above, the underwater surface 16 is that portion of the hull that is either constantly submerged or periodically wetted. In the illustration of FIG. 5, each of the two portions of the hull, 20 and 22, are coated with an electrically conductive paint on their outer surfaces. A first portion 50 of the underwater surface and a second portion 52 of the underwater portion are painted to cover the port 20 and starboard 22 sides of the watercraft 10. In the example shown in FIG. 5, the first and second portions, 50 and 52, are electrically insulated from each other. In other words, no electrical contact between the first and second portions exist in the region identified by reference numeral 56. In this type of application, where the first and second portions of the underwater service are insulated from each other except for the electric current path through the water, an oscillating signal can be used to alternatively cause current to flow from the first surface 50 to the second surface 52 and then in the reverse direction. This can be accomplished by providing a first conductor 58 in electrical communication with the electrically conductive paint on the first surface 50. Similarly, a second conductor 59 would be provided in electrical communication with the electrically conductive paint on the second surface 52. The controller 54 can alternately cause an electric current to flow from the first conductor 58 to the second conductor 59, through the surrounding water, and then switch this condition to cause electric current to flow from the second conductor 59 to the first conductor 58, also through the water surrounding and in contact with the hull of the boat.

It has been discovered that the flow of electric current from an underwater surface discourages the growth of marine organisms, such as barnacles. Tests have been conducted in salt water with various electrically conductive surfaces. It has been determined that relatively small magnitudes of electric current flowing from the surfaces significantly inhibits growth of marine organisms.

Figure 6:
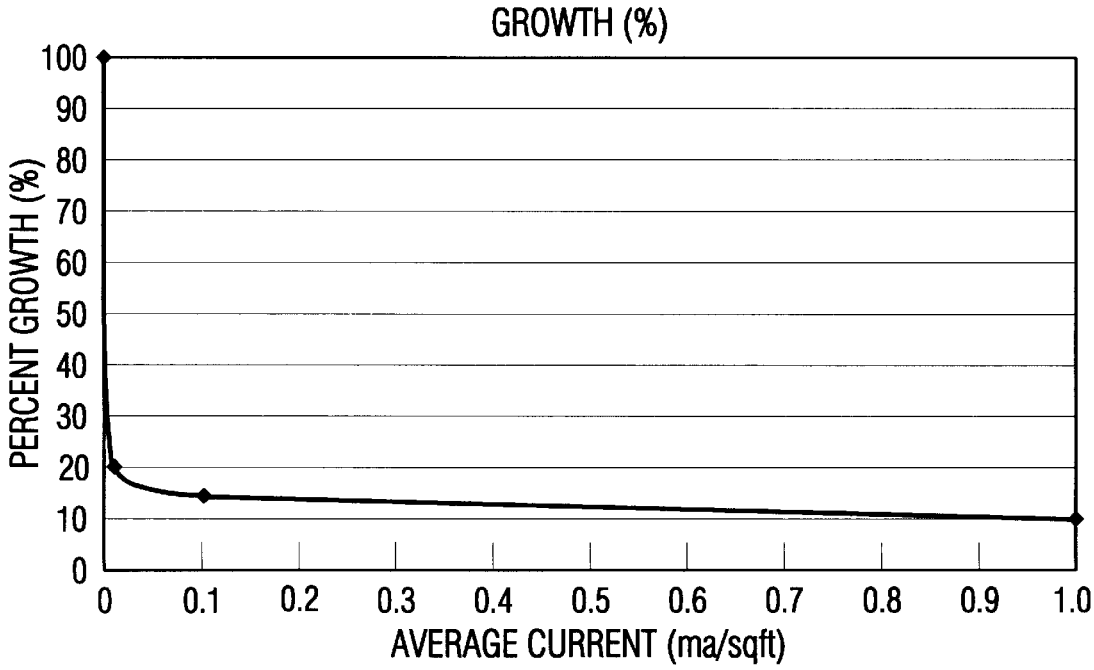
FIG. 6 is a graphical representation of the reduction in marine growth as a function average current.

FIG. 6 shows the graphical results of several tests involving electrically conductive surfaces submerged in salt water and provided with average currents of different magnitudes flowing from those surfaces. As can be seen, when no current is flowing from the test surface, normal marine organism growth occurs. This is defined as 100% growth for the purpose of these comparisons. When small magnitudes of average current are caused to flow from the surfaces, a significant decrease in marine organism growth is seen. With reference to FIG. 6, it can be seen that an average current as low as 0.1 milliamperes per square foot results in a significant reduction in the growth on an underwater surface. An average current of 1.0 milliamperes per square foot results in approximately 90% reduction in marine growth as shown in FIG. 6.

Figure 7:
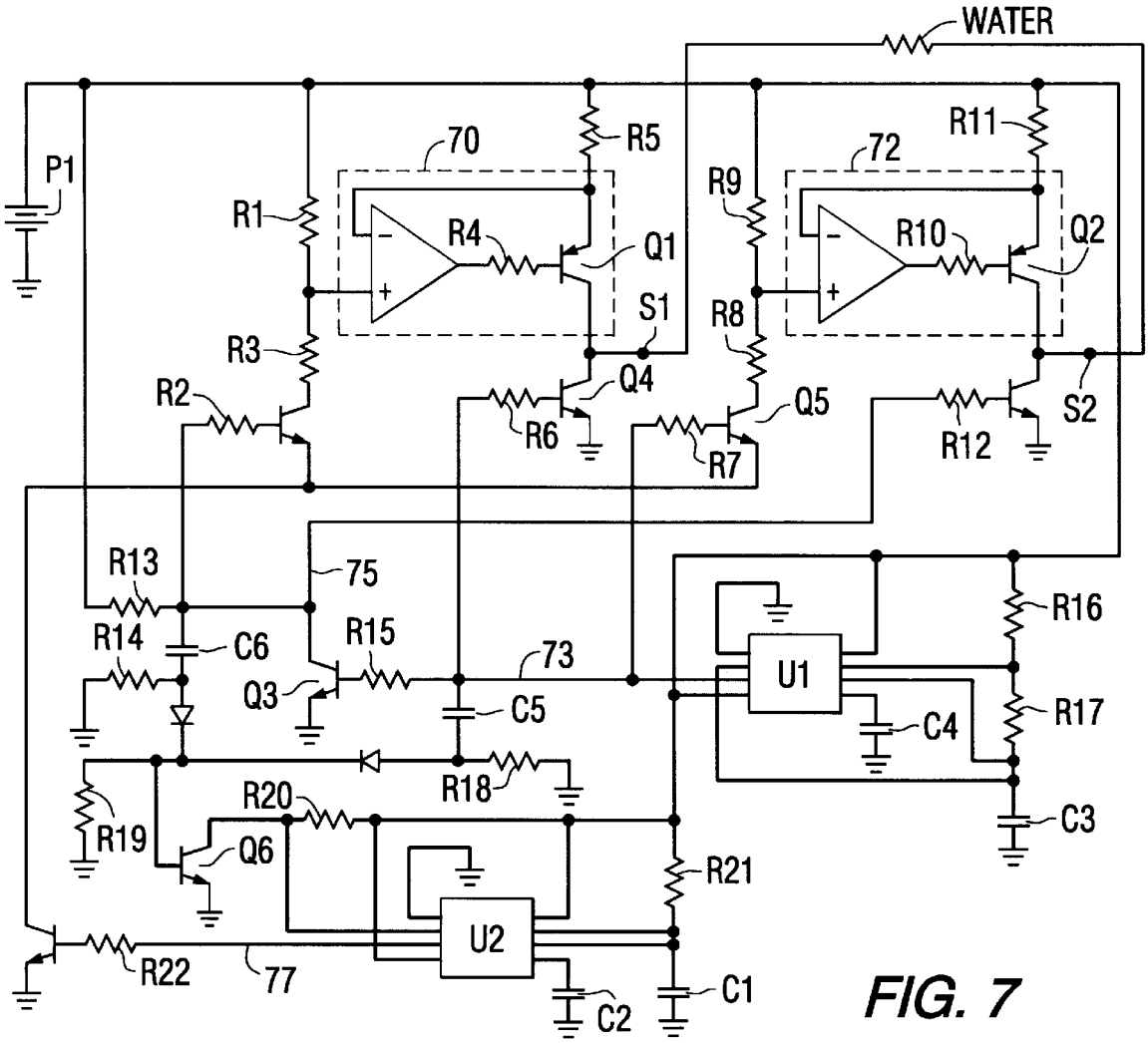
FIG. 7 is a schematic representation of a circuit used in conjunction with the present invention.
Figure 8:
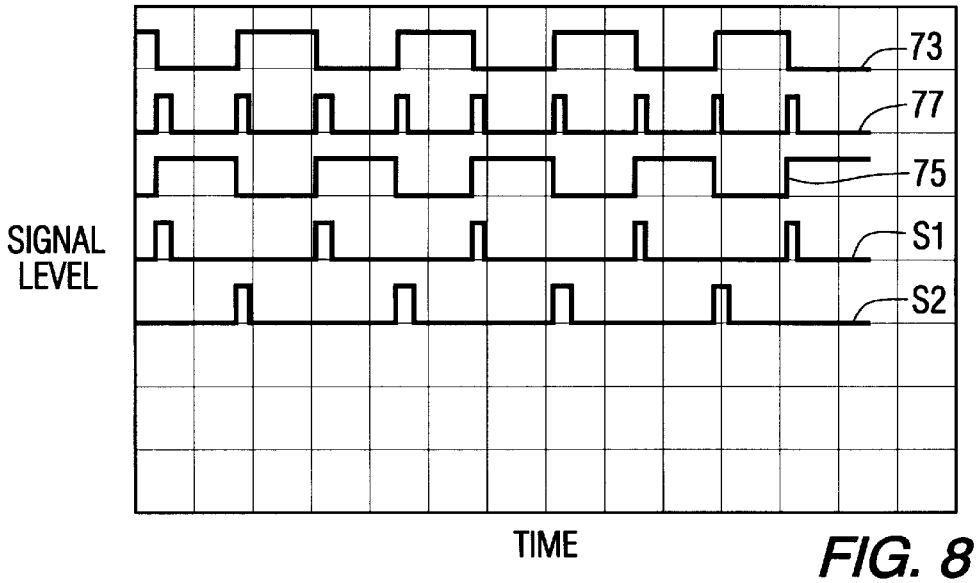
FIG. 8 is a graphical representation of several signals at various points of the circuit FIG. 7.

FIG. 7 schematically represents an electrical circuit that is suitable for accomplishing the purposes of the present invention. A source of power P1, such as a battery, is connected to the circuit which is capable of generating an oscillating current output in which two portions of an underwater surface conduct current between them in an oscillating manner. The dashed boxes in FIG. 7 identify the portion of the circuit that control the maximum current level $I_{MAX}$ and operate as constant current sources. A square wave oscillator U1 provides an output on line 73 which has the shape of curve 73 in FIG. 8. Transistor Q3 operate as an inverter to provide an inverted signal on line 75 which is represented in FIG. 8 as signal 75. Monostable oscillator U2 transmits signal 77 on line 77 as shown. Signals S1 and S2, as graphically represented in FIG. 8, cause current to flow from the points identified as S1 and S2 in FIG. 7 and pass from the underwater surface, through the water, to a point of ground potential. This completes the circuit for the current to flow between the portions of the underwater surface and a point of ground potential. The circuit illustrated in FIG. 7 causes the current to flow through the resistance of the water, as shown in the upper right portion of the circuit in FIG. 7, and to the other portion of the underwater surface. The types and values of the components shown in FIG. 7 are identified in Table 1 below.

Figure 9:
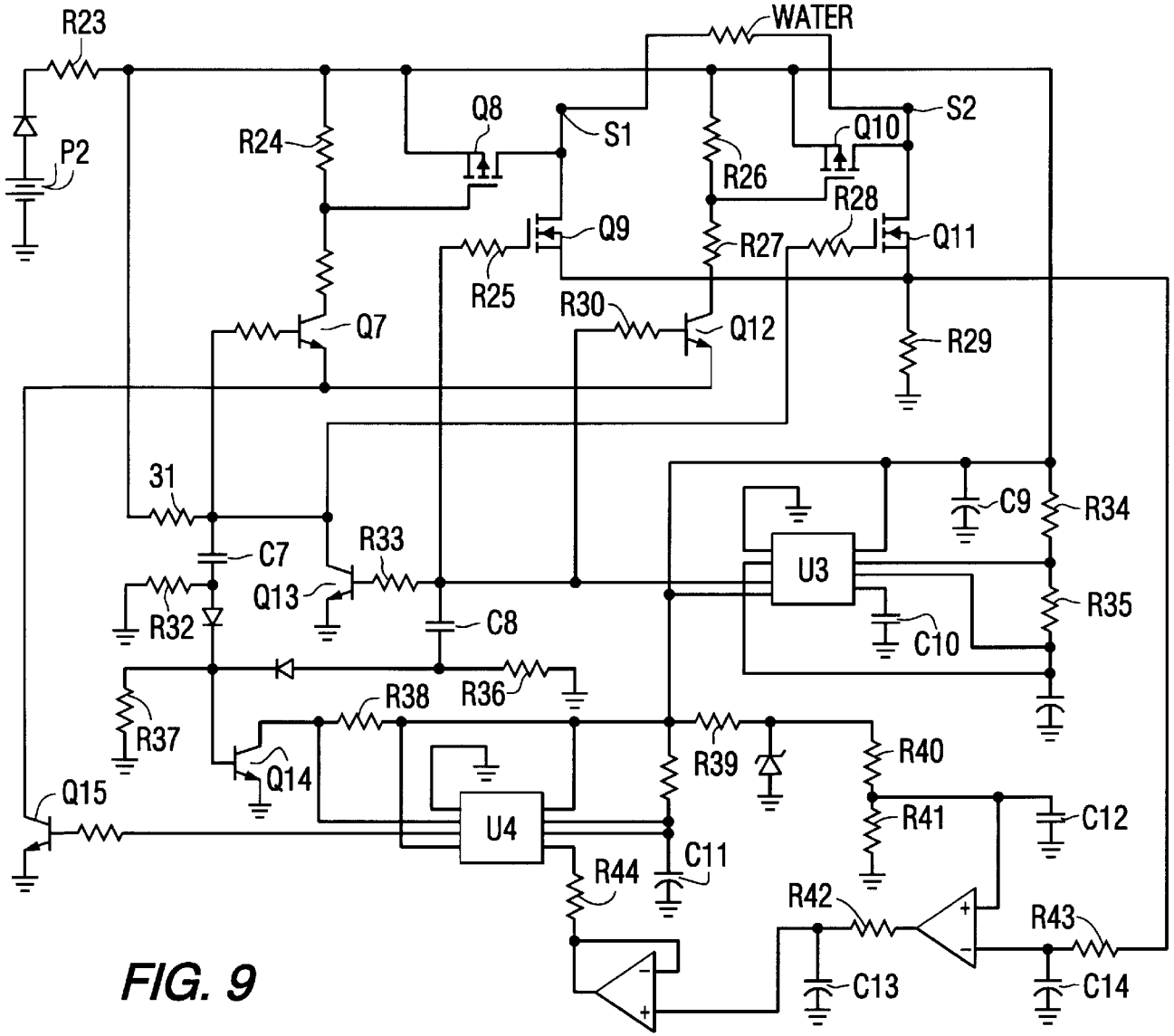
FIG. 9 is an alternative embodiment of the circuit showing in FIG. 7.

FIG. 9 is a schematic representation of another circuit that can be used in conjunction with the present invention. A significant portion of the circuit in FIG. 9 is identical to the circuit in FIG. 7, but the upper portion of the circuit in FIG. 9 has been altered to allow higher currents to be transmitted from the underwater surfaces.

In FIGS. 7 and 9, circuit points S1 and S2 represent the connection to the first and second portions of the underwater surface. As described above, the first and second portions of the underwater surface can be two areas of the hull. The type or value of the components in FIG. 7 and 9 are identified in Table 1.

TABLE I

| Reference Numeral | Value or Type |
|---|---|
| R1 | 100kΩ |
| R2 | 10kΩ |

TABLE I-continued

| Reference Numeral | Value or Type |
|---|---|
| R3 | 100kΩ |
| R4 | 1kΩ |
| R5 | 1Ω |
| R6 | 1kΩ |
| R7 | 10kΩ |
| R8 | 100kΩ |
| R9 | 100kΩ |
| R10 | 1kΩ |
| R11 | 1Ω |
| R12 | 1kΩ |
| R13 | 1kΩ |
| R14 | 10kΩ |
| R15 | 10kΩ |
| R16 | 1kΩ |
| R17 | 100kΩ |
| R18 | 10kΩ |
| R19 | 10kΩ |
| R20 | 10kΩ |
| R21 | 10kΩ |
| R22 | 10kΩ |
| R23 | 0.1Ω |
| R24 | 10kΩ |
| R25 | 1kΩ |
| R26 | 10kΩ |
| R27 | 1kΩ |
| R28 | 1kΩ |
| R29 | 0.01Ω |
| R30 | 10kΩ |
| R31 | 1kΩ |
| R32 | 10kΩ |
| R33 | 10kΩ |
| R34 | 1kΩ |
| R35 | 100kΩ |
| R36 | 10kΩ |
| R37 | 10kΩ |
| R38 | 10kΩ |
| R39 | 1kΩ |
| R40 | 10kΩ |
| R41 | 200Ω |
| R42 | 100kΩ |
| R43 | 100kΩ |
| R44 | 1kΩ |
| C1 | 1 μF |
| C2 | 0.01 μF |
| C3 | 1 μF |
| C4 | 0.01 μF |
| C5 | 0.1 μF |
| C6 | 0.1 μF |
| C7 | 0.01 μF |
| C8 | 0.01 μF |
| C9 | 1 μF |
| C10 | 0.01 μF |
| C11 | 1 μF |
| C12 | 0.01 μF |
| C13 | 1 μF |
| C14 | 1 μF |
| Q1 | PNP Transistor (Current Source) |
| Q2 | PNP Transistor (Current Source) |
| Q3 | NPN Transistor (Inverter) |
| Q4 | NPN Transistor (Current Sink) |
| Q5 | NPN Transistor (Control) |
| Q6 | NPN Transistor (Trigger) |
| Q7 | NPN Transistor (Control) |
| Q8 | MTP000T06V |
| Q9 | MTP36N06E |
| Q10 | MTP000T06V |
| Q11 | MTP36N06E |
| Q12 | NPN Transistor (Control) |
| Q13 | NPN Transistor (Inverter) |
| Q14 | NPN Transistor (Trigger) |
| U1 | Square Wave Oscillator |
| U2 | Monostable Oscillator |
| U3 | Square Wave Oscillator |
| U4 | Monostable Oscillator |

Figure 10:
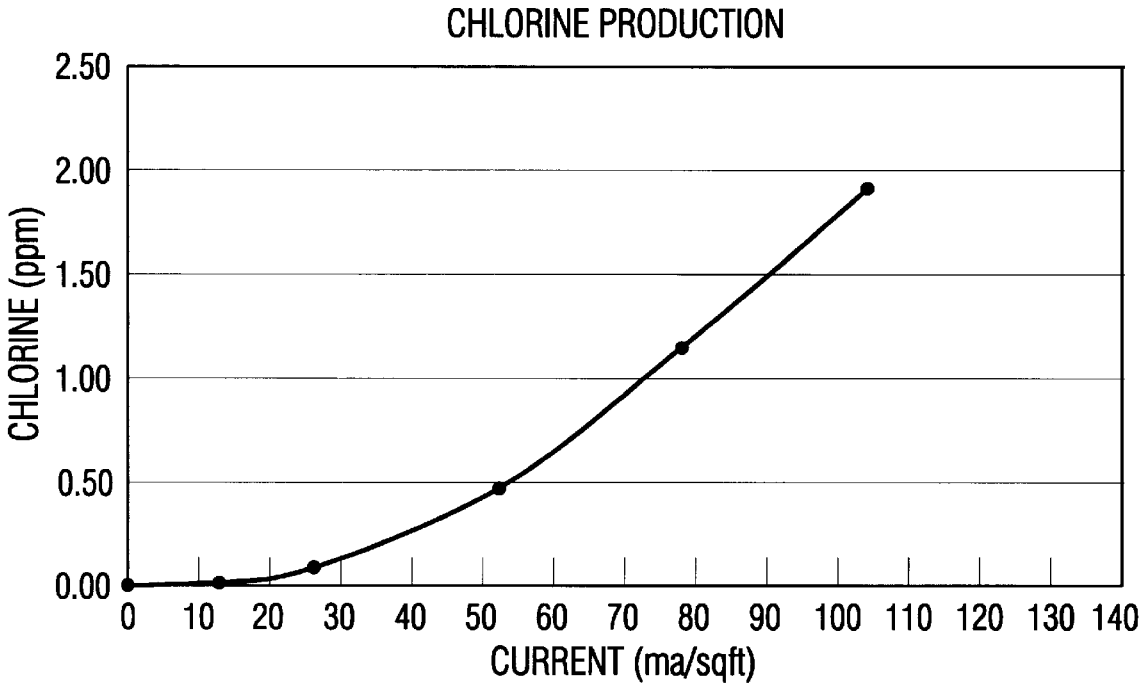
FIG. 10 shows the rate of production of chlorine as a function of average current density.

It has been empirically determined that the electric current provided by the present invention proximate an underwater surface inhibits and deters the growth of marine organisms, such as barnacles. The provision of an electric current flowing from an underwater surface has been shown to have this beneficial affect in reducing marine growth on the underwater surface. However, the precise mechanism by which marine organisms are discouraged from attaching to the underwater surface has not been conclusively proven. One possible reason for the success that has been seen in experiments with the present invention is that certain marine organisms, such as barnacles, abhor chlorine. When the present invention is used in a salt water environment, the flow of current from the underwater surface interacts with the surrounding salt water and produces chlorine gas, inter alia, in the form of very small bubbles at the underwater surface. In order to quantitatively define this relationship, an electric current was caused to flow in a pre-selected quantity of salt water for a pre-selected time. FIG. 10 shows the results of that effort.

In FIG. 10, it can be seen that the production of chlorine increases with the current flow. The quantity of chlorine, measured in parts per million, is produced at an increasing rate as a function of current, in milliamperes per square foot. In comparing FIGS. 6 and 10, it must be noted that the entire range of the horizontal axis in FIG. 6 is less than 1% of the horizontal axis in FIG. 10. In other words, very small amounts of chlorine are effective in reducing the amount of fouling on an underwater surface by marine organisms.

Those skilled in the art of electrolysis know that sodium chloride or potassium chloride electrolysis in aqueous solutions can be achieved in several known ways by using several known processes. In most commonly known methods, the anodic reaction is the same and proceeds under equal conditions ($2Cl^- \rightarrow Cl_2 + 2e^-$). The chloride ion gives up its excess negative charge (electron) with the consequent formation of free radicals (Cl). These then combine by pairs to build up chlorine molecules that evolve in the gaseous state.

If it is the chlorine production that actually prohibits the marine growth, it must be realized that wave movement, even if the boat is stationary, will constantly disperse chlorine bubbles that are attached to the hull surface. As a result, high production rates of chlorine do not always reflect themselves with high rates of reduced marine growth. As a result, the use of very high average currents to produce very high rates of chlorine production may not be efficient because much of the chlorine can be dispersed by wave action or boat movement. It is more efficient to produce chlorine at reduced rates, but continually. As a result, the small bubbles of chlorine that adhere to underwater surfaces will be replenished if they are dispersed by wave action or boat movement.

With regard to FIG. 10, it can be seen that there is a dramatic increase in the production of chlorine as a function of increased current. Therefore, it should be expected that the efficacy of the present invention can be enhanced by using increased current densities. However, this does not necessarily require increased average current densities as described above in conjunction with FIGS. 3, 4, and 6. For example, if it is desired to operate the present invention with an average current density of 1.0 milliamperes per square foot, FIG. 10 would indicate that using a current $I_{MAX}$ of 100 milliamperes per square foot with a duty cycle of 1% would be significantly more effective than using a current density of 10 milliamperes per square foot with a duty cycle of 10%. The relationship of chlorine production to current, as shown in FIG. 10 indicates that increasing the current $I_{MAX}$ by 100% increases the chlorine production by more than 100%.

These results indicate that it is more efficient and effective, for any desired average current density, to maximize the current magnitude $I_{MAX}$ and select a duty cycle which results in the average current density in conjunction with the higher current $I_{MAX}$. This may not be effective for all applications of the present invention, but actual testing in salt water indicates that increasing the current $I_{MAX}$ has a significantly beneficial effect on the efficacy of the present invention. The selection of a duty cycle, in conjunction with the current $I_{MAX}$, can be used to respond to the power limitations in any particular application. In other words, a lower duty cycle with a higher current $I_{MAX}$ can reduce the overall drain on the batteries of a marine vessel while maintaining the inhibition of marine growth on the hull of the vessel.

With reference to FIG. 6, it can be seen that less than 0.03 milliamperes per square foot, as an average current, is sufficient to reduce marine growth by more than 80%. Furthermore, it can also be seen that significant increases in the average current are required to achieve an additional 10% reduction in marine growth. This result can possibly be explained by the fact that even high production rates of chlorine are not as effective in totally eliminating barnacle growth as the initial magnitudes of chlorine production are in significantly reducing barnacle growth. This result may be due to the action of wave movement on the test pieces. In addition, as chlorine production is increased, the size of the chlorine bubbles may be increased to a degree that allows them to be more easily dislodged from the underwater surface. As a result, rapid chlorine production is not necessarily as efficient as might be expected in view of the effectiveness of lower currents in reducing marine organism growth.

Test plates have indicated that the present invention provides an effective means for significantly reducing the growth of marine organisms on a conductive plate. The flow of electric current from the plate into the water has been shown to be highly effective for these purposes. It has also been discovered that the flow of current is more highly effective from the underwater surface than to the underwater surface. In other words, the underwater surface which is to be protected from marine fouling should be connected to the anode of a power source. A plate connected to the cathode of a power source is not protected in the same effective manner. However, periodic connection to the cathode of a power source does not defeat the beneficial effect of periodic connection to the anode of a power source. In other words, if the circuit is designed, as in the circuits of FIGS. 7 and 9, to alternate anodic connection to a pair of surface portions that oscillating current is effective to minimize marine growth on both portions while avoiding any galvanic corrosion to the two portions.

Although the present invention has been described with particular detail and illustrated to specifically show several preferred embodiments, it should be understood that alternative embodiments are also within its scope. The primary goal of the present invention is to reduce marine growth by passing an electric current in the region proximate an underwater surface.

I claim:

1. Apparatus for inhibiting the fouling of an underwater surface, comprising:

an electric current source, which is connectable in electrical communication with said underwater surface, for causing an electrical current to be transmitted from said underwater surface and into water which is in contact with said underwater surface, said underwater surface being a hull of a watercraft and being made of an electrically nonconductive material on which an electrically conductive paint is adopted to be disposed as a coating on said underwater surface, said electrically conductive paint being connectable in electrical communication with said electric current source; and a source of electrical power connected in electrical communication with said electric current source, said underwater surface having a first surface portion and a second surface portion, said first and second surface portions being electrically insulated from each other except for said water being disposed electrically between said first and second surface portions, said first and second surface portions being connectable to said electric current source in an oscillating manner to cause said first and second surface portions to automatically reverse electrical polarities relative to each other on a periodic basis under the control of said electric current source and to create gaseous chlorine from a selected one of said first and second surface portions when said selected one of said first and second surface portions is connected electrically by said electric current source as an anode.

2. The apparatus of claim 1, wherein:

said electric current source is adapted to form an electrical circuit in series with said underwater surface, a point of electrical ground potential and said water surrounding said watercraft.

3. A method for inhibiting the fouling of an underwater surface, comprising:

causing an electrical current to flow from an electric current source and proximate an underwater surface by disposing an electrically conductive paint on said underwater surface and connecting said electrically conductive paint to said electric current source, said electrical current being transmitted into water which is in contact with said underwater surface;

providing a source of electrical power connected in electrical communication with said electric current source;

forming an electrical circuit comprising said electric current source, a point of ground potential and said water surrounding a watercraft, said underwater surface being a first portion of a hull of a watercraft, said point of ground potential being a second portion of said hull of said watercraft; and electrically switching, under the automatic control of said electric current source, said first and second portions of said hull with respect to said electric current direction to periodically reverse the direction of said electrical current flowing from said electric current source and through said water to produce gaseous chlorine on each of said one of said first and second portions of said hull when said each one of said first and second portions of said hull is connected as an anode to said electric current source.

4. Apparatus for inhibiting fouling of an underwater surface of a hull of a marine vessel disposed in salt water, comprising:

a pulse generator, adapted for electrical connection to said underwater surface, for propagating a series of current pulses from said underwater surface of sufficient magnitude to produce gaseous chlorine bubbles from said underwater surface of said hull of said marine vessel; and a source of electrical power connected to said pulse generator.

5. A system for inhibiting the growth of marine organisms on an underwater surface of a watercraft, comprising:

a source of electrical power;

a current source circuit, connected to said source of electrical power;

an electrical conductor connectable in electrical communication with water which is in contact said underwater surface;

a point of ground potential associated with said current source circuit and said electrical conductor adapted to provide a path for an electric current through said water proximate said underwater surface, said underwater surface being a hull of said watercraft, said hull comprising a first portion and a second portion, said first and second portions each being coated with a coating of electrically conductive paint, said first and second portions being electrically separated from each other except for said current path through said water between the coating of electrically conductive paint on said first portion and the coating said electrically conductive paint on said second portion, said coatings of electrically conductive paint of each of said first and second portions being alternately connectable to a point of voltage potential of higher magnitude than the point of voltage potential connected to the other portion to cause said electric current to alternately flow from said coatings of electrically conductive paint on said first and second portions and to produce gaseous chlorine from said hull.

6. The system of claim 5, wherein:

said current is provided as a series of pulses of a preselected duty cycle.

7. The system of claim 6, wherein:

said duty cycle is changeable.

* * * * *